US006802194B1

(12) United States Patent
Shen

(10) Patent No.: US 6,802,194 B1
(45) Date of Patent: Oct. 12, 2004

(54) CLUTCH MECHANISM FOR A LOCK

(76) Inventor: Mu-Lin Shen, No. 18, Gong-Yeh 3 Road, An-Nan District, Tainan (TW)

( * ) Notice: Subject to any disclaimer, the term of this patent is extended or adjusted under 35 U.S.C. 154(b) by 0 days.

(21) Appl. No.: 10/688,310

(22) Filed: Oct. 16, 2003

(51) Int. Cl.[7] ..... E05B 13/10

(52) U.S. Cl. ..... 70/223; 70/224; 70/472; 292/DIG. 27

(58) Field of Search ..... 70/149, 188–189, 70/218, 221–224, 422, 472; 292/336.3, DIG. 27

(56) References Cited

U.S. PATENT DOCUMENTS 4,424,691 A * 1/1984 Foshee ..... 70/224
4,921,289 A * 5/1990 Shen ..... 292/336.3
5,598,726 A * 2/1997 Cordle ..... 70/224
5,768,926 A * 6/1998 Shen ..... 70/224
5,794,472 A * 8/1998 Kester et al. ..... 70/223
6,041,630 A 3/2000 Shen
6,279,360 B1 * 8/2001 Shen ..... 70/224
6,364,383 B1 4/2002 Shen
6,497,126 B2 * 12/2002 Wang ..... 70/224
6,575,006 B1 * 6/2003 Don ..... 70/223
6,615,630 B2 * 9/2003 Wu et al. ..... 70/223
6,705,138 B1 * 3/2004 Shen ..... 70/224

* cited by examiner

*Primary Examiner*—Daniel P. Stodola
*Assistant Examiner*—Christopher Boswell
(74) *Attorney, Agent, or Firm*—Nikolai & Mersereau, P.A.; Alan D. Kamrath

(57) ABSTRACT

A lock includes an outside spindle, an outside hub for rotatably receiving the outside spindle, a cam received in the outside spindle, and a sleeve received in the cam and slidable along a longitudinal direction of the outside spindle. A lug is formed on an end of the cam and operably connected to the retractor. The sleeve includes a longitudinal slot having an enlarged section. A peg is mounted in the cam and received in the longitudinal slot of the sleeve. The sleeve is engaged with the outside spindle to turn therewith. When the locking bar is moved to a locking position, the peg is located in the enlarged section such that the sleeve and the outside spindle turn freely without causing rotation of the cam when the outside spindle is turned.

10 Claims, 10 Drawing Sheets

CLUTCH MECHANISM FOR A LOCK

BACKGROUND OF THE INVENTION

1. Field of the Invention

The present invention relates to a clutch mechanism for a lock. In particular, the present invention relates to a clutch mechanism for a lock that allows the outer handle to rotate freely when the lock is in a locked state so that the internal parts of the lock will not be damaged.

2. Description of the Related Art

A conventional door lock generally includes an outer handle and an inner handle respectively attached to the outside and the inside of a door so that the latch bolt can be retracted by turning either one of the outer handle and the inner handle. When in a locked state, the outer handle could not be turned for retracting the latch bolt. It is, however, not uncommon that the user still applies force to the outer handle to an extent that is normally sufficiently large enough for retracting the latch bolt if the user is not aware of the locked state of the lock. Thus, the inner parts of the lock connected to the handle could be damaged by a torque resulting from the force applied to the outer handle. The situation worsens for a lock with lever type handles.

U.S. Pat. No. 6,041,630 discloses a lock having a clutch mechanism to solve this problem. The lock includes an inner handle having a locking bar received therein and an outer handle connected to a spindle with a retaining base received therein which has two first grooves defined therein. A cam is connected to the retaining base and has two second grooves which communicate with the first grooves so that a locking piece is movably received between the retaining base and the cam with a spring biased between the locking piece and the retaining base. The locking piece has two flanges movably received in the first grooves and the second grooves. A slide is movably received in the cam and contacts the locking piece at one end thereof and the locking bar at the other end thereof so that the two flanges of the locking piece are disengaged from the second grooves when the locking bar is pushed. Therefore, the outer handle can be freely rotated. Nevertheless, there are too many elements for the clutch mechanism. The assembly procedure is too complicated and the overall cost is increased. Further, the lock can only be mounted to a door with a standard thickness.

U.S. Pat. No. 6,364,383 discloses a door lock that allows adjustment of longitudinal position of an outside rose and an adjusting sleeve relative to the outside seat to suit a thickness of a door to which the door lock is mounted. The door lock also provides a burglar-proof effect for the outside rose assembly by means of providing an anti-torque ring.

The present invention is intended to provide a clutch mechanism for a lock that allows the outside handle to turn freely when the lock is in a locked state.

SUMMARY OF THE INVENTION

An object of the present invention is to provide a clutch mechanism for a lock that allows the outside handle to rotate freely when the lock is in a locked state so that the internal parts of the lock will not be damaged even though an excessive force is applied to the outside handle.

Another object of the present invention is to provide a clutch mechanism for a lock that allows the outside handle to rotate freely while allowing adjustment of the lock to suit a thickness of a door to which the door lock is mounted.

In accordance with an aspect of the invention, a lock comprises:

a latch;

a retractor for retracting the latch;

an inside handle;

an inside spindle having a first end fixed to the inside handle to turn therewith and a second end, the inside spindle being operably connected to the retractor such that rotation of the inside spindle causes retraction of the latch;

a locking bar extending through the inside spindle;

an inside hub for rotatably receiving the second end of the inside spindle;

an outside handle;

an outside spindle having a first end and a second end fixed to the outside handle to turn therewith;

an outside hub for rotatably receiving the first end of the outside spindle;

a cam received in the first end of the outside spindle, the cam including a first end and a second end, a lug being formed on the first end of the cam and operably connected to the retractor, an elastic element being received in the cam, a peg being mounted in the cam; and a sleeve received in the cam and slidable along a longitudinal direction of the outside spindle, the sleeve including a longitudinal slot having an enlarged section, the peg being received in the longitudinal slot of the sleeve, the sleeve being engaged with the outside spindle to turn therewith while allowing the sleeve to move longitudinally in the cam;

wherein when the locking bar is moved to a locking position, the peg is located in the enlarged section such that the sleeve and the outside spindle turn freely without causing rotation of the cam when the outside spindle is turned.

In an embodiment of the invention, the first end of the outside spindle includes a slot in an end face thereof. The slot extends along the longitudinal direction of the outside spindle. The sleeve includes an arm extending therefrom, with the arm extending into the slot of the outside spindle and longitudinally slidable along the slot.

The outside hub includes a restraining recessed portion and the arm extends into the restraining recessed portion. The restraining recessed portion has two ends for limiting rotational movement of the arm. The first end of the sleeve includes a hole for securely engaging with an end of the locking bar.

The cam includes an engaging portion and the outside handle includes a cylinder mounted therein. The cylinder includes a cylinder bar engaged with the engaging portion of the cam, allowing joint rotation of the cylinder bar and the cam.

The outside hub includes an outside seat that has an outer threading with two diametrically disposed flat surfaces. A reinforcing ring includes two positioning posts extending outward therefrom and two diametrically disposed flat sections in an inner periphery delimiting a hole thereof. The reinforcing ring is mounted around the outside seat, with the flat sections of the reinforcing ring being in contact with the flat sections of the outside seat. An adjusting sleeve includes an inner threading threadedly engaged with the outer threading of the outside seat. An outside rose is mounted to the outside handle. The adjusting sleeve is securely engaged with the outside rose such that rotation of the outside rose causes longitudinal movement of the adjusting sleeve and the outside rose until the retractor is located in a center of a thickness of a door to which the lock is mounted.

Each positioning post of the reinforcing ring has a screw hole. An inside rose liner is mounted around the inside hub and includes at least one pair of positioning holes, with two screws extending through one pair of the positioning holes of the inside rose liner into the screw holes of the positioning posts of the reinforcing ring. The inside rose includes a threaded inner periphery for engaging with an outer threading on the inside hub. The outside rose includes a central stepped portion having a central through-hole. The adjusting sleeve has an end securely engaged with the central stepped portion of the outside rose.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
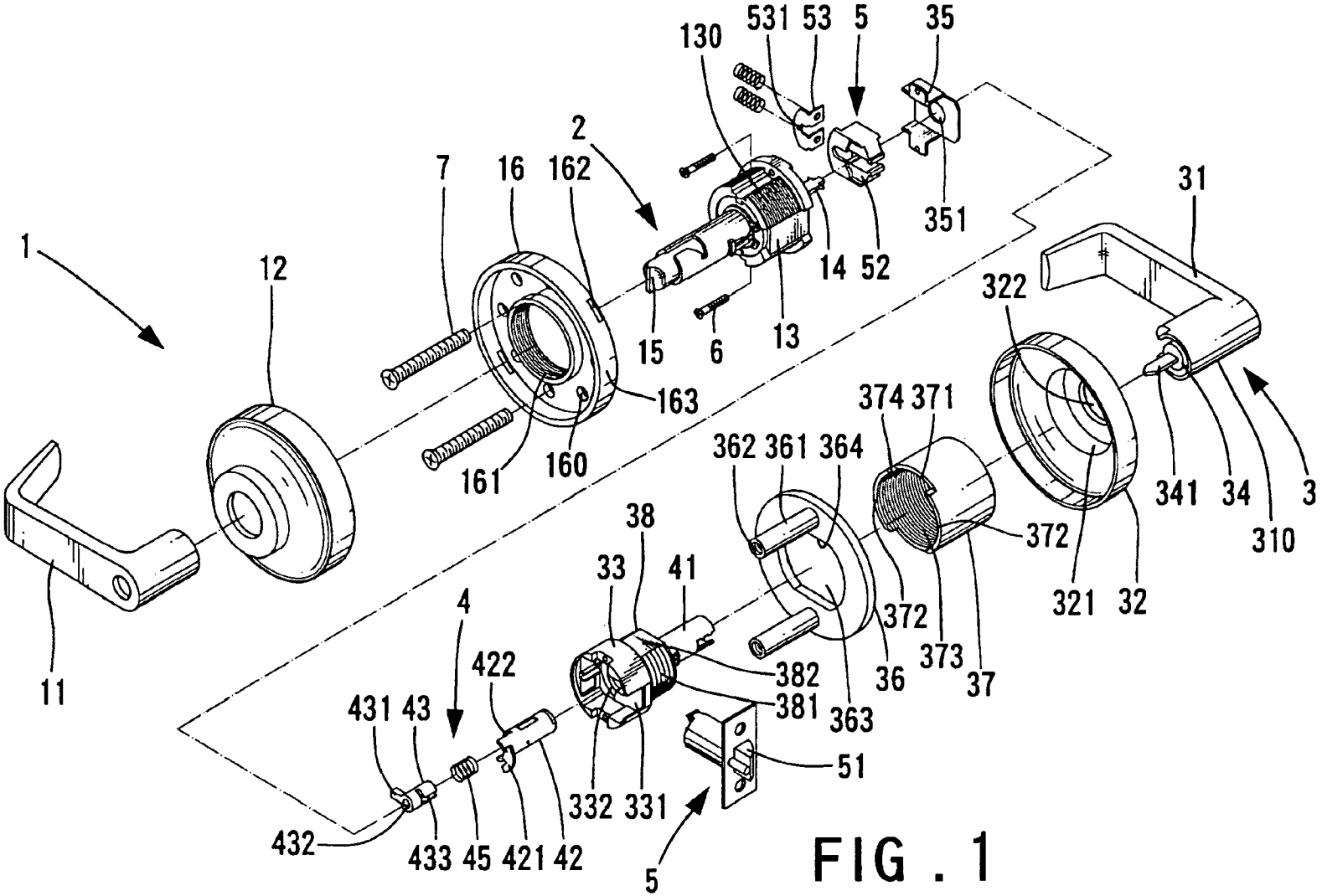
FIG. 1 is an exploded perspective view of a lock in accordance with the present invention.

Referring to FIG. 1, a lock in accordance with the present invention generally comprises an inside handle assembly 1, an inside spindle 2, an outside handle assembly 3, an outside transmission assembly 4, and a latch mechanism 5.

Figure 2:
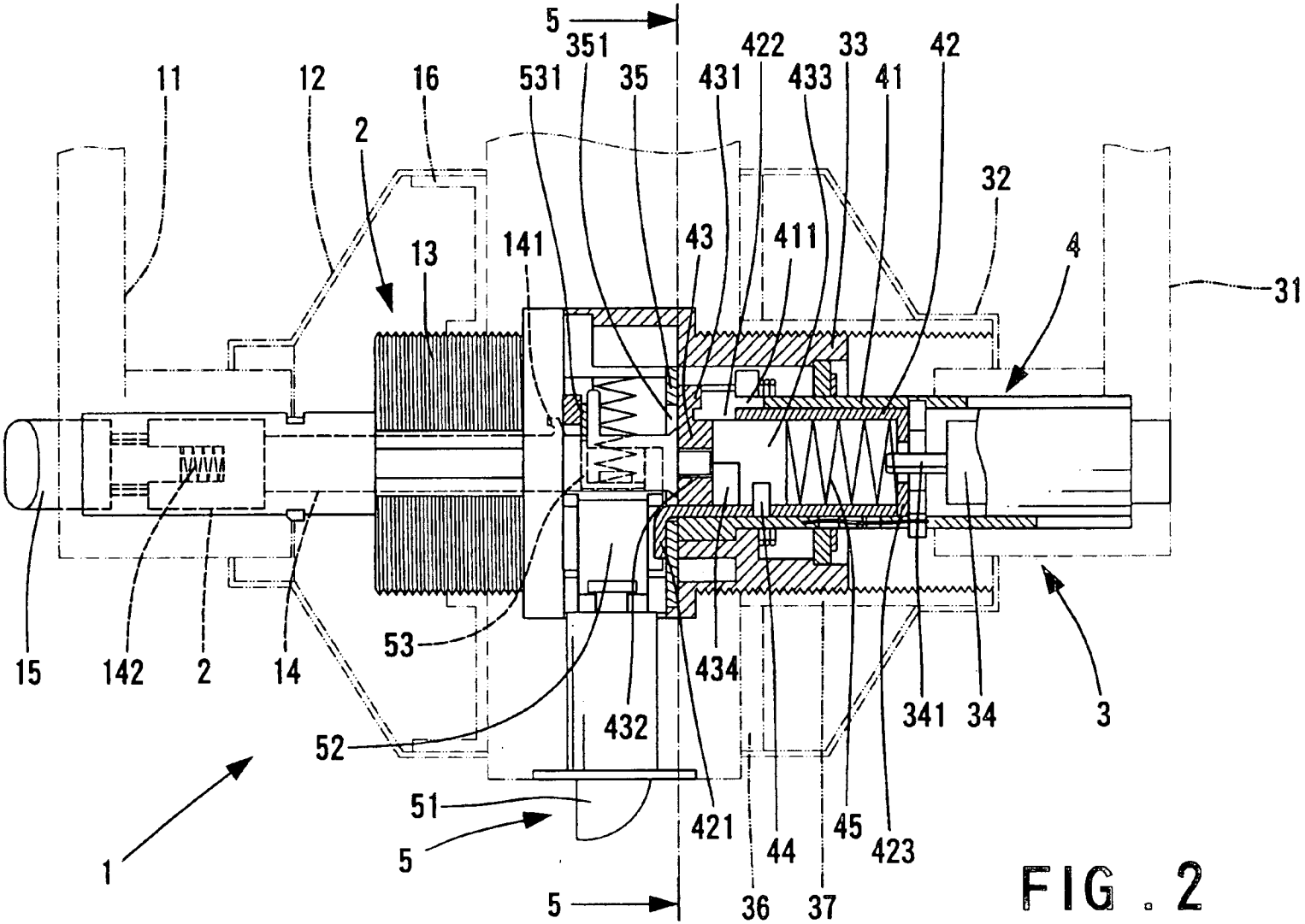
FIG. 2 is a sectional view of the lock in accordance with the present invention, wherein the lock is in an unlocked state.

The inside handle assembly 1 includes an inside handle (e.g., a lever 11), an inside rose 12 to which an end of the inside lever 11 is mounted, and an inside rose liner 16 mounted inside the inside rose 12. The inside rose liner 16 includes an inner threading 161 and a plurality of positioning holes 160. The inside spindle 2 is mounted to an inside hub 13. Also mounted to the inside hub 13 is an inner side of the inside rose 12. The outside handle assembly 3 includes an outside handle (e.g., a lever 31) and an outside rose 32 mounted to an end of the outside lever 31. The outside transmission assembly 4 is mounted to an outside hub 33 that is mounted to an inner side of the outside rose 32. The outside hub 33 and the inside hub 13 are connected together by fasteners 6. A locking bar 14 extends through the inside spindle 2 and is movable along a longitudinal direction of the inside spindle 2. A push button 15 is attached to an end of the locking bar 14 and exposed outside the inside lever 11, as shown in FIG. 2.

A cylinder 34 is mounted in a shank 310 of the outside lever 31 and has a cylinder bar 341 protruding therefrom. A seat 35 is securely mounted in the outside hub 33 for positioning the outer transmission assembly 4. The latch mechanism 5 is mounted in the outside hub 33 and operably connected to the inside spindle 2 and the outer transmission assembly 4. The latch mechanism 5 includes a latch 51 that extends out of the outside hub 33 via a notch 331 of the outside hub 33. The latch 51 is retractable by a retractor 52, and a catch 53 is mounted in the retractor 52.

The outside hub 33 includes an outside seat 38, which, in turn, includes an outer threading 381 having two diametrically disposed flat surfaces 382. The lock further includes a reinforcing ring 36 and an adjusting sleeve 37. The reinforcing ring 36 includes two positioning posts 361 extending outward therefrom and two diametrically disposed flat sections 364 in an inner periphery delimiting a hole 363 thereof. The reinforcing ring 36 is mounted around the outside seat 38 with the flat sections 364 being in contact with the flat surfaces 382 of the outside seat 38. In addition, a screw hole 362 in each positioning post 361 is aligned with an associated positioning hole 160 of the inside rose liner 16. Screws 7 are extended through two of the positioning holes 160 of the inside rose liner 16 and the screw holes 362 of the positioning posts 361.

The adjusting sleeve 37 includes an inner threading 373 for engaging with the outer threading 381 of the outside seat 38. The adjusting sleeve 37 further includes two diametrically opposed cutouts 371 in an end thereof, thereby forming two sector wings 372 each having two end faces 374, each end face 374 defining an end of an associated cutout 371. The sector wings 372 of the adjusting sleeve 37 are inserted into the hole 363 of the reinforcing ring 36 with each end face 374 bearing against an associated end of the associated flat section 364. The outside rose 32 includes a central stepped portion 321 with a central through-hole 322. The central stepped portion 321 fittingly receives the other end of the adjusting sleeve 37 to rotate therewith.

Figure 3:
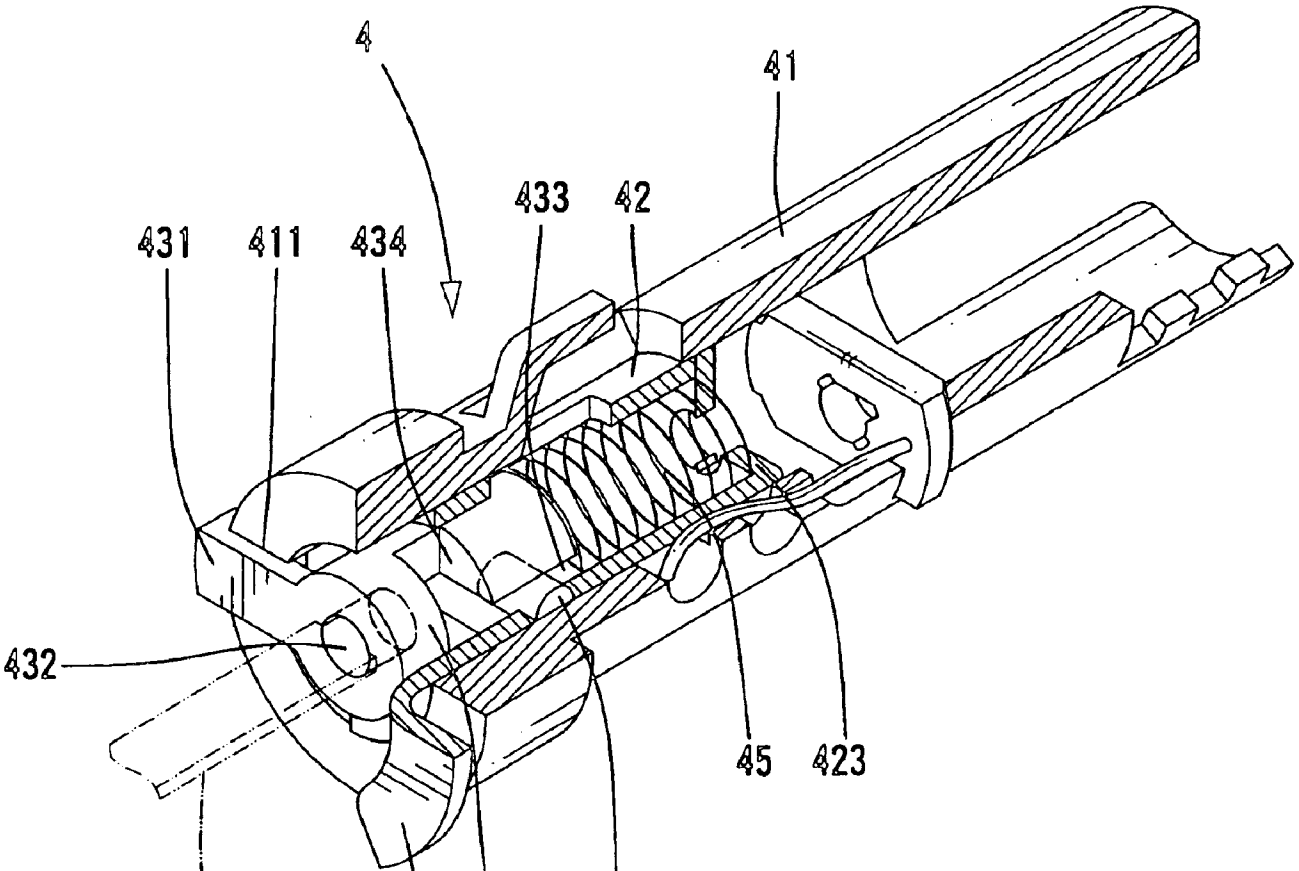
FIG. 3 is a perspective view, partly cutaway, of a portion of an outside transmission assembly of the lock in accordance with the present invention.
Figure 4:
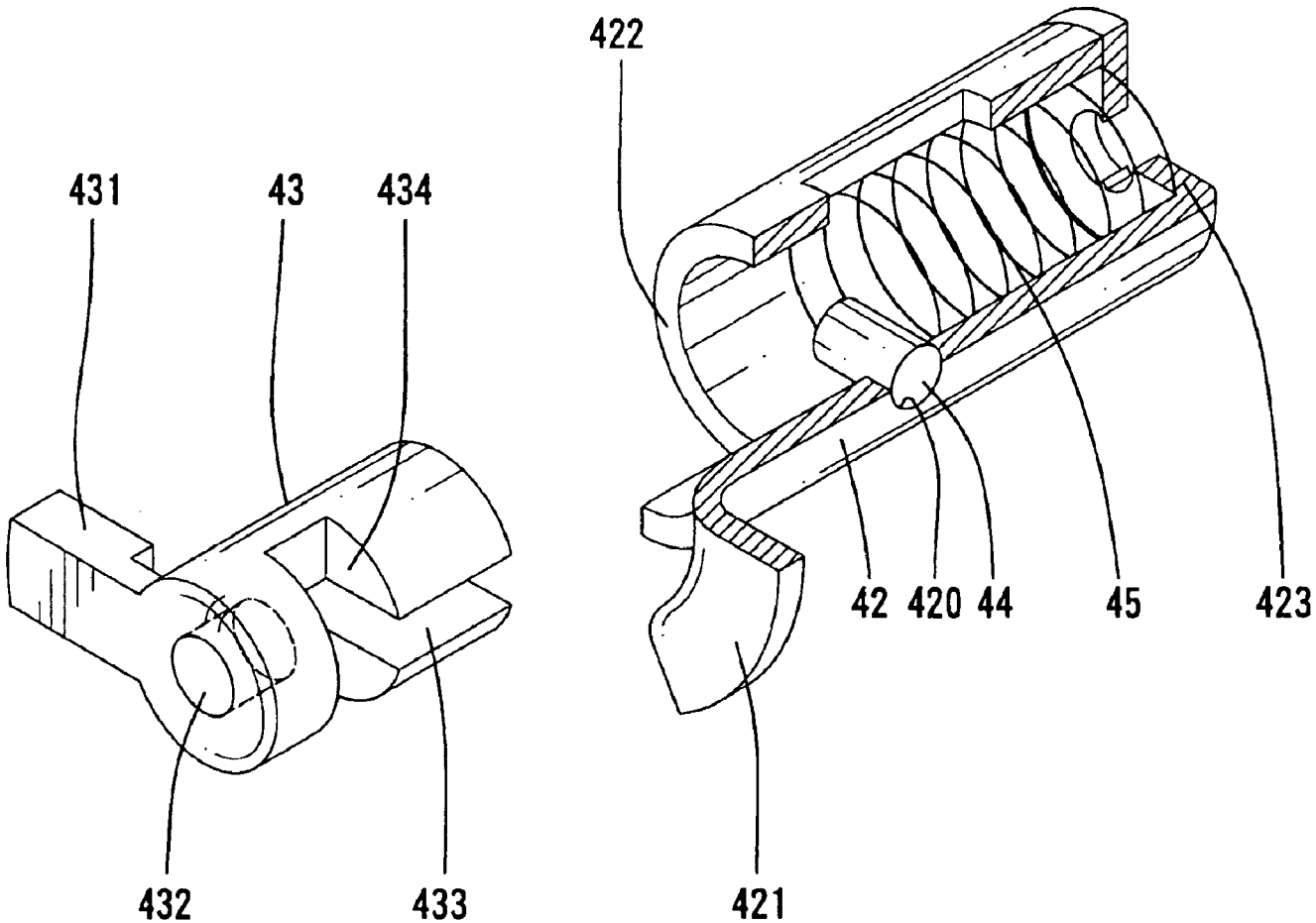
FIG. 4 is an exploded perspective view of a sleeve and a cam of the outside transmission assembly, with the cam being partly cutaway to show interior structure.

Referring to FIGS. 2 through 4, the outside transmission assembly 4 includes an outside spindle 41 having a first end received in the outside hub 33 and a second end fixed to the outside lever 31 to turn therewith. The outside transmission assembly 4 further includes a cam 42 received in the first end of the outer spindle 41, and a sleeve 43 received in the cam 42.

The first end of the outside spindle 41 includes a slot 411 (FIG. 3) defined in an end face thereof and extending along a longitudinal direction of the outside spindle 41. The cam 42 includes a lug 421 projecting radially outward from an end thereof and a notch 422 defined in the end thereof. Preferably, the lug 421 is diametrically opposed to the notch 422. The notch 422 of the cam 42 is aligned with the slot 411 of the outside spindle 411. An elastic element 45 is mounted in the cam 42 and restrained between a peg 44 and the other end of the cam 42. The peg 44 is inserted into the cam 42 via a radial hole 420 (FIG. 4) of the cam 42. The other end of the cam 42 includes an engaging portion 423 that is engaged with the cylinder bar 341 of the cylinder 34.

As illustrated in FIGS. 3 and 4, the sleeve 43 includes a longitudinal slot 433 in an end thereof, with the longitudinal slot 433 having an enlarged section 434. A hole 432 is defined in the other end of the sleeve 43. Further, an arm 431 extends outward from the other end of the sleeve 43. The locking bar 14 has an end securely engaged in the hole 432 of the sleeve 43, allowing joint movement (including longitudinal movement and rotational movement) of the locking bar 14 and the sleeve 43. The cylinder bar 341 of the cylinder 34 is securely engaged in the engaging portion 423 of the cam 42, allowing joint rotation of the cylinder bar 341 and the cam 42. The arm 431 of the sleeve 43 is engaged in the notch 422 of the cam 42 and the slot 411 of the outside spindle 41.

Figure 5:
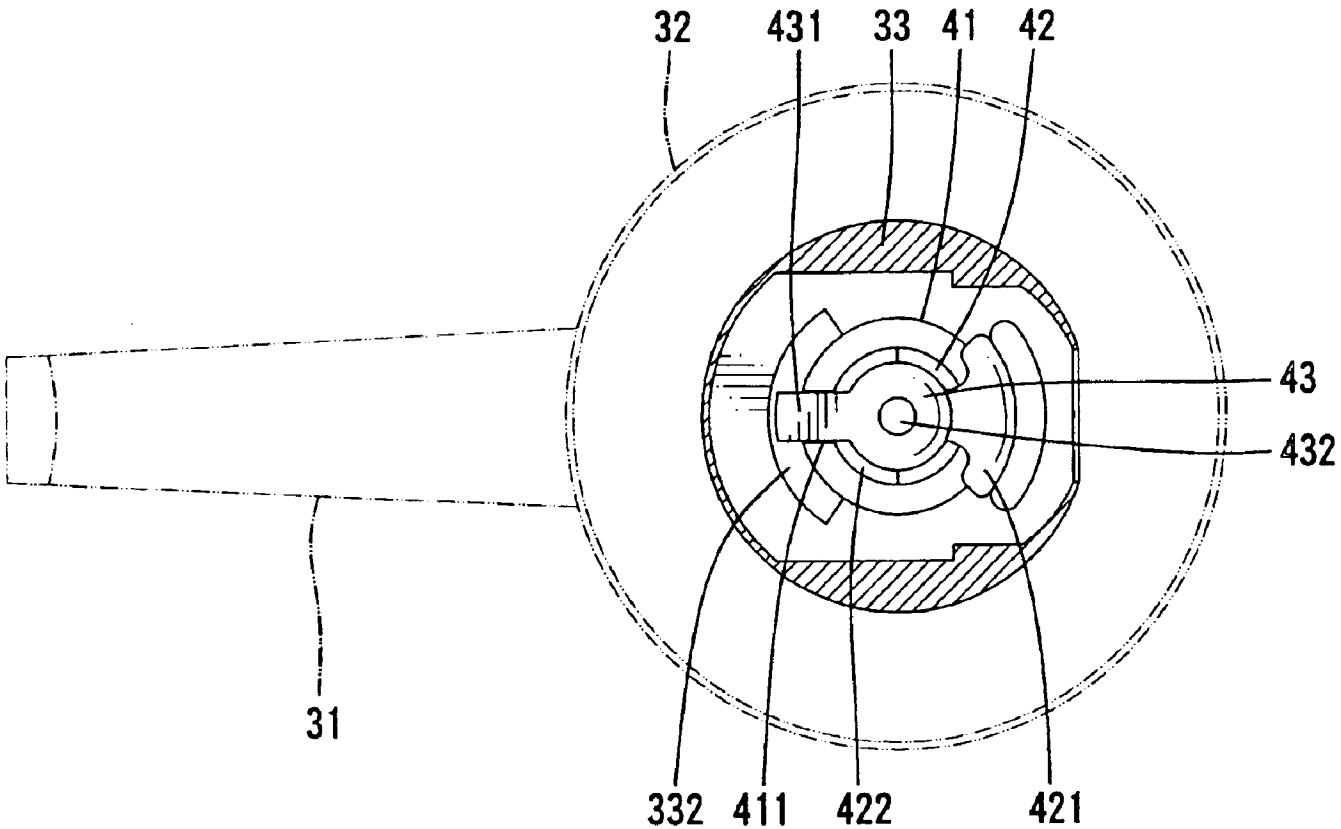
FIG. 5 is a sectional view taken along plane 5-5 in FIG. 2.

As illustrated in FIGS. 3 and 5, the sleeve 43 is mounted in the cam 42, with the peg 44 being received in the longitudinal slot 433 of the sleeve 43, with the elastic element 45 abutting against the other end of the sleeve 43. The longitudinal slot 433 of the sleeve 43 has a width slightly greater than a diameter of the peg 44, allowing relative longitudinal sliding movement between the sleeve 43 and the peg 44. The enlarged section 434 of the longitudinal slot 433 is long enough to allow the peg 44 to turn in the enlarged section 434 without causing rotational movement of the sleeve 43, which will be described later. The arm 431 of the sleeve 43 extends into a restraining recessed portion 332 of the outside hub 33. The lug 421 of the cam 42 extends through the opening 351 of the seat 35 and is operably connected to the retractor 52.

When mounting the lock of the present invention to a thin or thick door (i.e., not a door with a standard thickness), the reinforcing ring 36 is firstly disengaged from the adjusting ring 37. Then, the outside rose 32 is turned, the adjusting sleeve 37 securely mounted in the outside rose 32 is also turned. By means of turning the outside rose 32, the adjusting sleeve 37 and the outside rose 32 move longitudinally relative to the outside seat 38 due to threading engagement 381 and 373. Thus, position of the adjusting sleeve 37 and the outside rose 32 can be adjusted to suit the thickness of the door. The outside hub 33 and the inside hub 13 that are connected together are inserted into a hole (not labeled) of the door. The positioning posts 361 of the reinforcing ring 36 are extended through two positioning holes (not labeled) of the door. The sector wings 372 of the positioned adjusting sleeve 37 are located in the hole 363 of the reinforcing ring 36. The retractor 52 is located in a center of the door thickness and thus faces an opening (not shown) in a door frame (not shown). The inner rose liner 16 is then mounted to the inside hub 13 and the screws 7 are extended through the positioning holes 160 of the inside rose liner 16 and the screw holes 362 of the positioning posts 361. Next, the inside rose 12 and the inside handle 11 are mounted to finish the assembly procedure.

Thus, when mounting the lock to a door, the installer may simply rotate the outside rose 32 to adjust the position of the outside rose 32 and the adjusting sleeve 37 to suit the door thickness without the need of detaching the outside rose 32 and the outside lever 31. The outer end of the adjusting sleeve 37 is shielded by the stepped portion 321 of the outside rose 32 such that finish plating is not required. The threaded inner periphery 161 of the inside rose liner 16 is threadedly engaged with an outer threading 130 of the inside hub 13. In addition, a plurality of notches 162 are defined in an outer periphery 163 of the inside rose liner 16 such that the installer may insert a tool into the respective notch 162 to turn and thus move the inside rose liner 16 relative to the inside hub 13, thereby moving the inside rose liner 16 to a place where the inside rose liner 16 is positioned.

Figure 6:
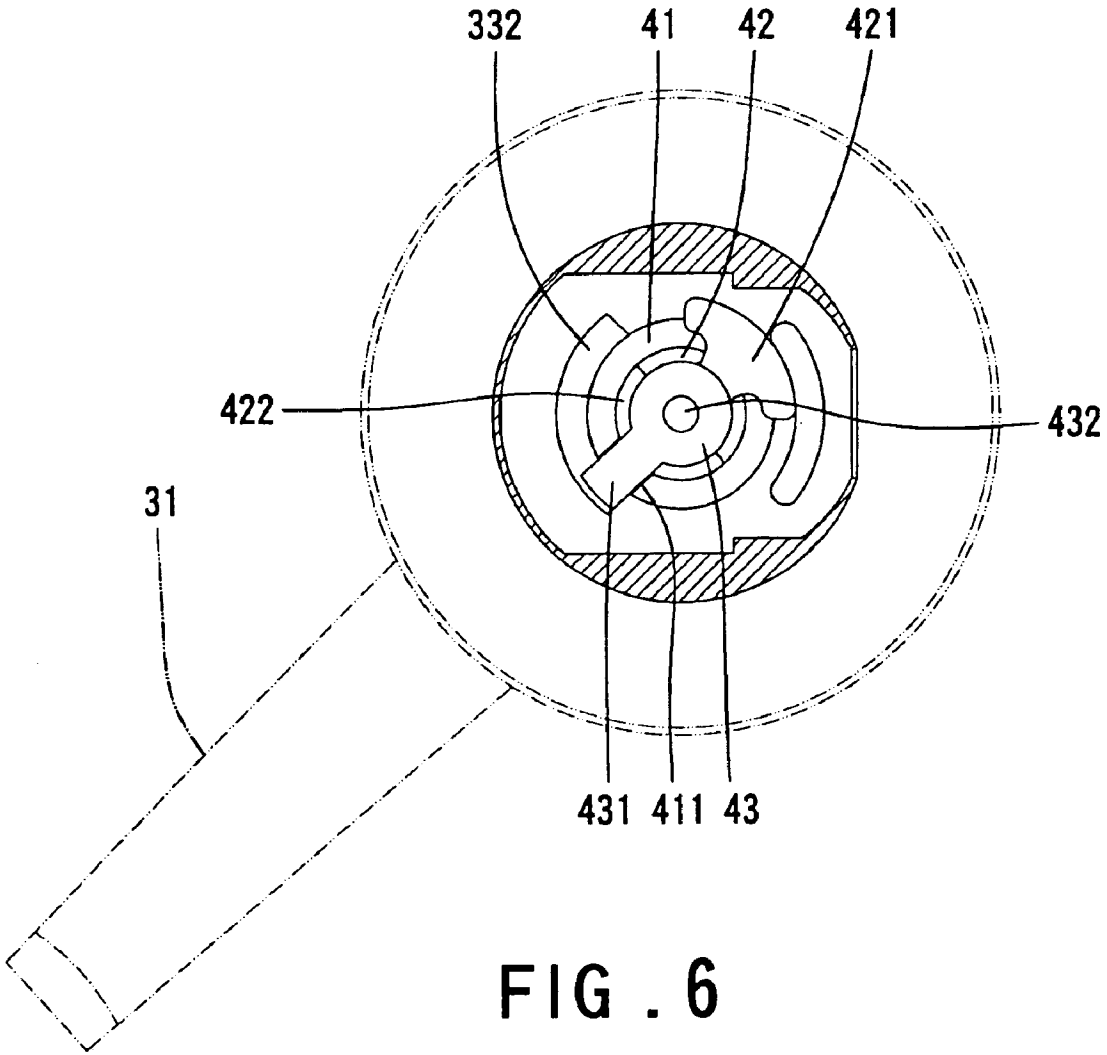
FIG. 6 is a view similar to FIG. 5, illustrating free rotation of the outside handle when the lock is in the unlocked state.

Referring to FIGS. 3 and 5, when the lock is in an unlocked state, the peg 44 is in the longitudinal slot 433 of the sleeve 43 but outside the enlarged section 434. Referring to FIG. 6, when the outside lever 31 is turned, the outside spindle 41 turns together with the outside lever 31. The sleeve 43 and the cam 42 are also turned. The retractor 52 is actuated, causing retraction of the latch 51 and thus allowing opening of the door to which the lock is mounted. The latch 51 returns to its initial position when the outside lever 31 is released.

Figure 7:
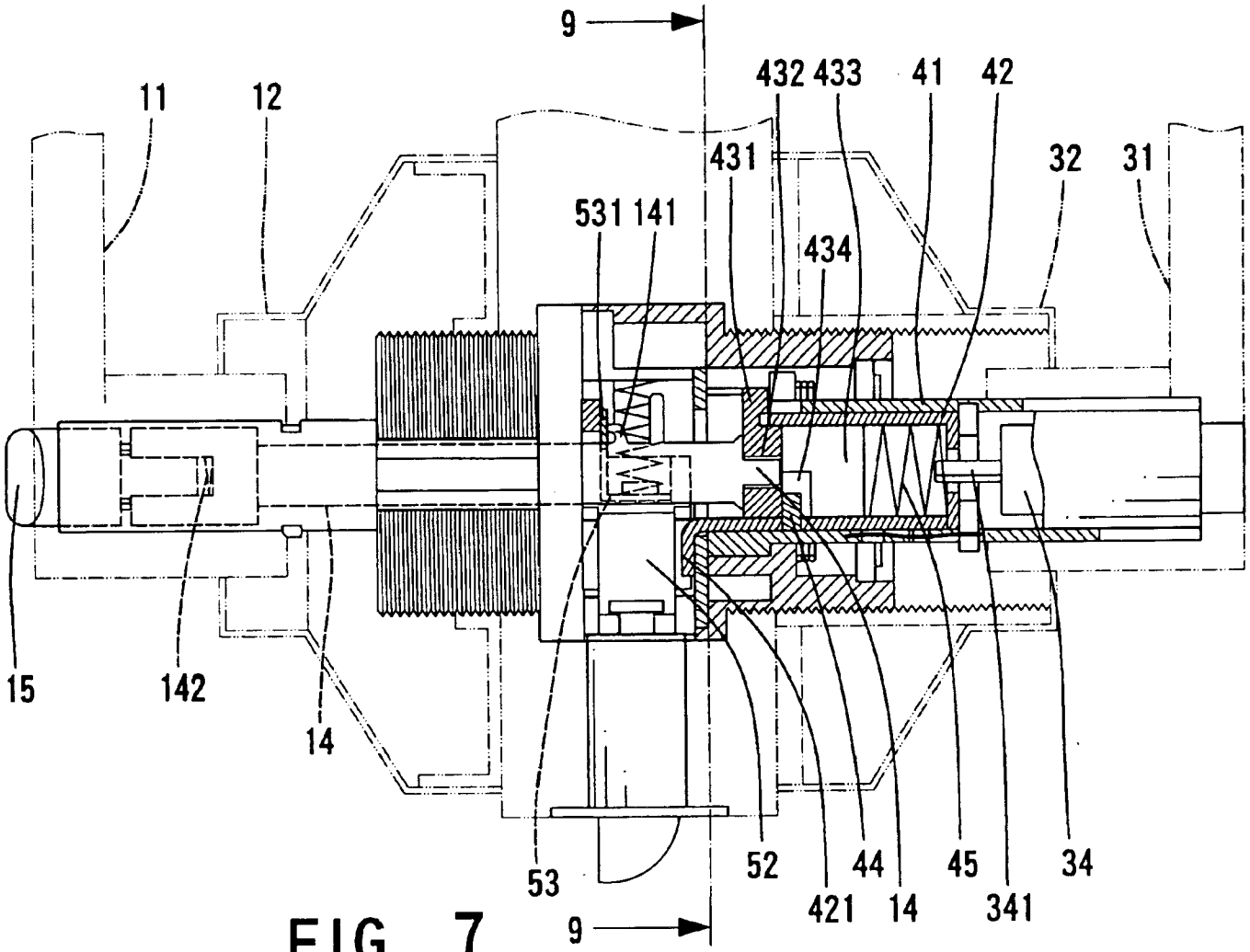
FIG. 7 is a view similar to FIG. 2, wherein the lock is in a locked state.
Figure 8:
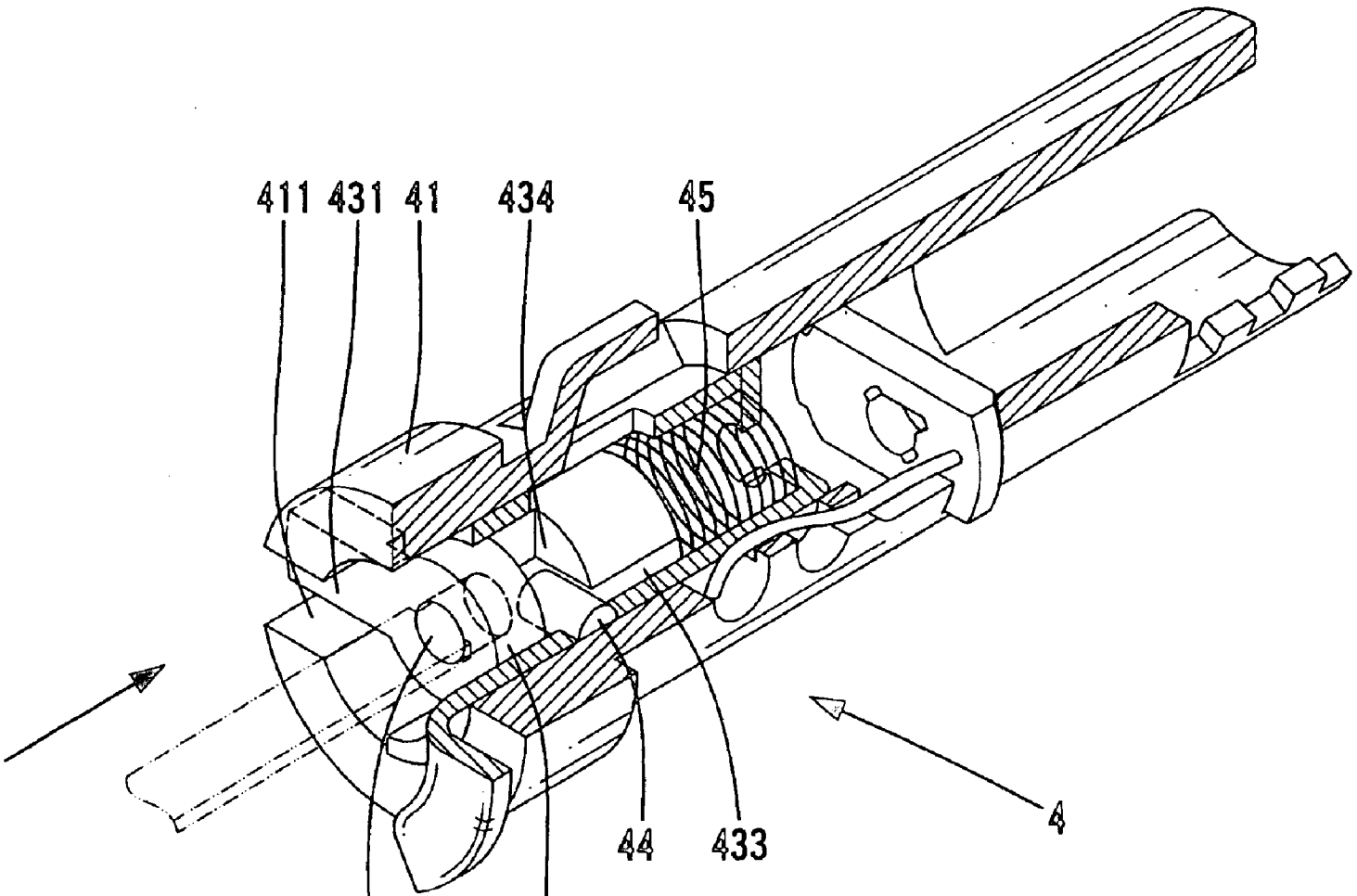
FIG. 8 is a perspective view similar to FIG. 3, wherein the lock is in the locked state.
Figure 9:
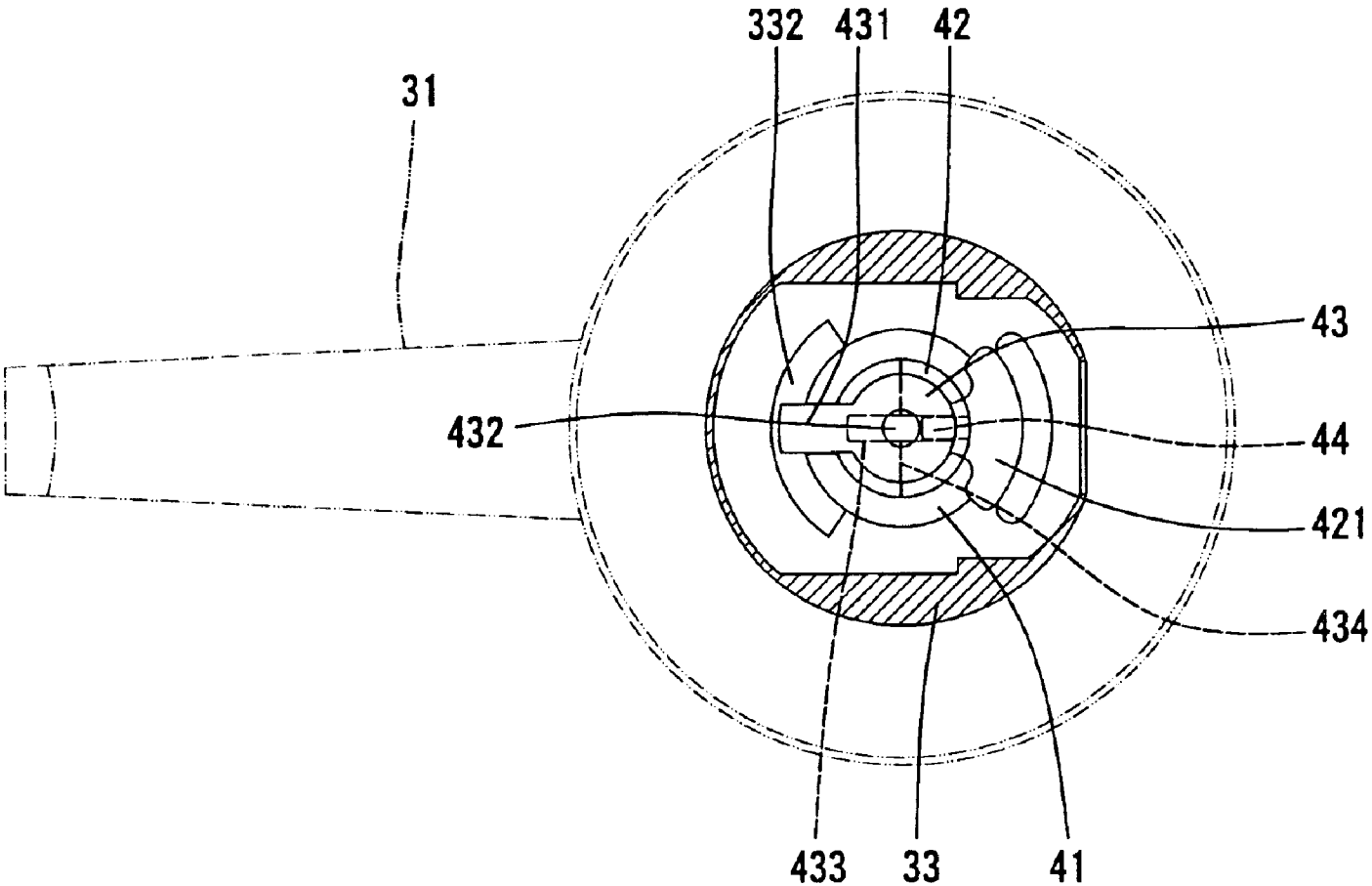
FIG. 9 is a sectional view taken along plane 9-9 in FIG. 7 wherein the lock is in a locked state.

Referring to FIG. 7, when the push button 15 is pushed, the locking bar 14 is moved inward to a locking position, which, in turn, causes inward movement of the sleeve 43 in the cam 42. An engaging member 141 on the locking bar 14 is engaged with an engaging member 531 on the catch 53. Further, the elastic element 45 is compressed, and the peg 44 is now located in the enlarged section 434 of the sleeve 43, as shown in FIGS. 8 and 9.

Figure 10:
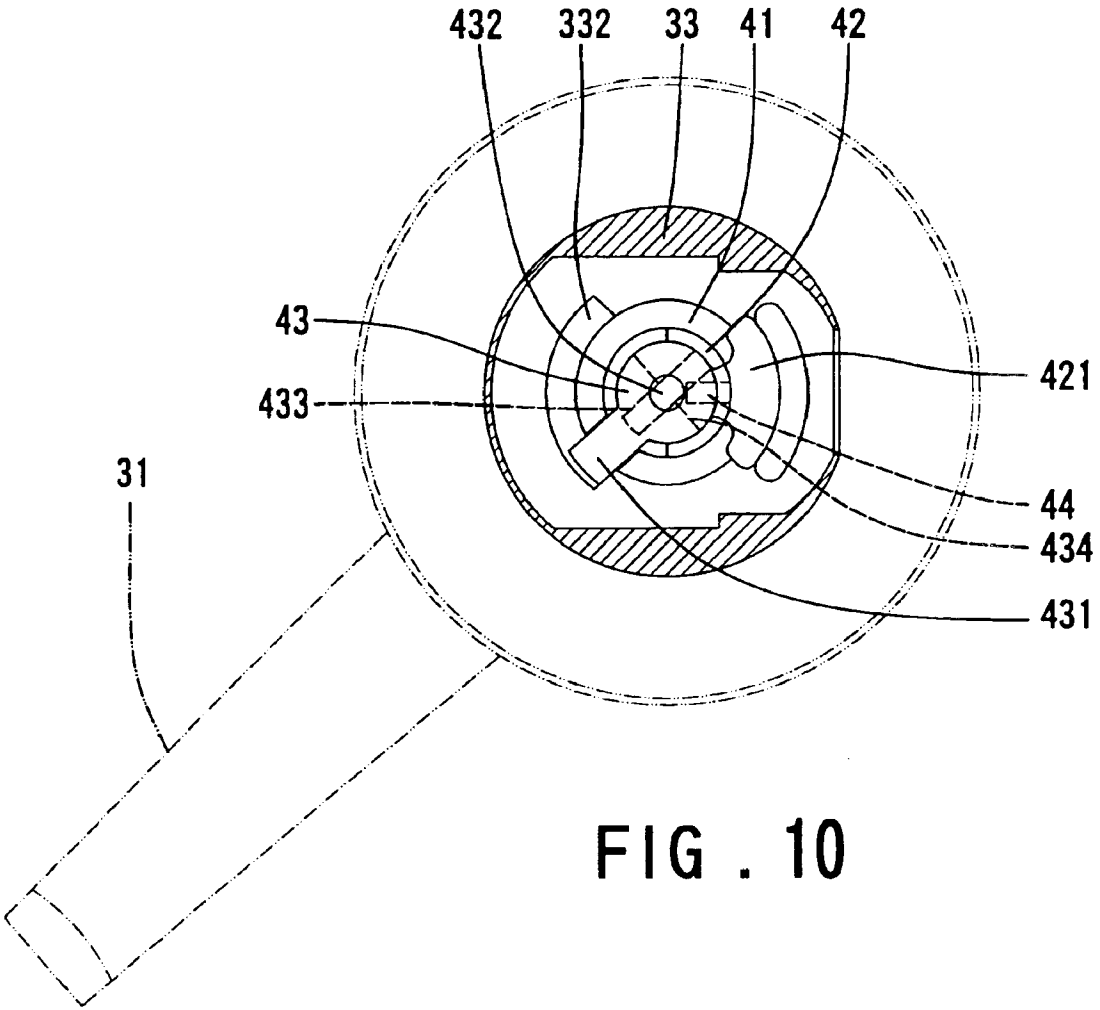
FIG. 10 is a view similar to FIG. 9, illustrating free rotation of the outside handle when the lock is in the locked state.

Referring to FIG. 10, when the outside lever 31 is turned while the lock is in the locked state, the outside spindle 41 and the sleeve 43 turn without causing rotation of the cam 42. This is because the peg 44 is allowed to move in the enlarged section 434 of the sleeve 43 along a direction perpendicular to the longitudinal axis. Thus, the outside lever 31 turns freely without causing retraction of the latch 51. Thus, damage to the inner parts of the lock resulting from turning of the outside lever 31 while the lock is in the locked state is avoided. Unlatching operation of the lock in a locked or unlocked state by means of turning the inside handle 11 is conventional and therefore not described.

The maximum pivotal movement of the outside lever 31 is generally 45 degrees, and it is determined by the arcuate length of the restraining recessed portion 332 of the outside hub 33 that receives the arm 431 of the sleeve 43. Namely, when the outside lever 31 is turned, movement of the arm 431 of the sleeve 43 is limited by two ends of the restraining recessed portion 332 of the outside hub 33. Further, each of the notch 422 of the cam 42 and the enlarged section 434 of the sleeve 43 has an appropriate arcuate length to allow the sleeve 43 to turn freely through approximately 180 degrees in the cam 42. Further, the depths of the slot 411 of the outside spindle 41 and the restraining recessed portion 332 of the outside hub 33 allow longitudinal movement of the arm 431 of the sleeve 43 away from the outside hub 33.

When a proper key (not labeled) is inserted into the cylinder 34 and turned through a predetermined angle, the cam 42 is turned, as the cylinder bar 341 of the cylinder 34 is securely engaged in the engaging portion 423 of the cam 42. The retractor 52 is moved inward by the lug 421 of the cam 42, achieving the unlatching function. The engaging member 531 on the catch 53 is disengaged from the engaging member 141 on the locking bar 14, and the locking bar 14 returns its initial position under the action of a return spring 142 (FIG. 7). The sleeve 43 returns to its initial position shown in FIG. 2 under the action of the elastic element 45.

According to the above description, it is appreciated that the outside transmission assembly 4 in accordance with the present invention provides a clutch mechanism that allows the outside handle 31 to rotate freely when the lock is in a locked state so that the internal parts of the lock will not be damaged. Further, the lock of the present invention can be adjusted to suit doors of different thicknesses.

Although the invention has been explained in relation to its preferred embodiment, it is to be understood that many other possible modifications and variations can be made without departing from the scope of the invention as hereinafter claimed.

What is claimed is:

1. A lock comprising:

a latch;

a retractor for retracting the latch;

an inside handle;

an inside spindle having a first end fixed to the inside handle to turn therewith and a second end, the inside spindle being operably connected to the retractor such that rotation of the inside spindle causes retraction of the latch;

a locking bar extending through the inside spindle;

an inside hub for rotatably receiving the second end of the inside spindle;

an outside handle;

an outside spindle having a first end and a second end fixed to the outside handle to turn therewith;

an outside hub for rotatably receiving the first end of the outside spindle;

a cam received in the first end of the outside spindle, the cam including a first end and a second end, a lug being formed on the first end of the cam and operably connected to the retractor, an elastic element being received in the cam, a peg being mounted in the cam; and a sleeve received in the cam and slidable along a longitudinal direction of the outside spindle, the sleeve including a longitudinal slot having an enlarged section, the peg being received in the longitudinal slot of the sleeve, the sleeve being engaged with the outside spindle to turn therewith while allowing the sleeve to move longitudinally in the cam;

wherein when the locking bar is moved to a locking position, the peg is located in the enlarged section such that the sleeve and the outside spindle turn freely without causing rotation of the cam when the outside spindle is turned.

2. The lock as claimed in claim 1, with the first end of the outside spindle including a slot in an end face thereof, the slot extending along the longitudinal direction of the outside spindle, the sleeve including an arm extending therefrom, with the arm extending into the slot of the outside spindle and longitudinally slidable along the slot.

3. The lock as claimed in claim 2, with the first end of the sleeve including a hole, with the locking bar having an end securely engaged in the hole of the sleeve.

4. The lock as claimed in claim 1, with the outside hub including a restraining recessed portion, with the arm extending into the restraining recessed portion, the restraining recessed portion having two ends for limiting rotational movement of the arm.

5. The lock as claimed in claim 1, with the cam including an engaging portion, with the outside handle including a cylinder mounted therein, the cylinder including a cylinder bar engaged with the engaging portion of the cam, allowing joint rotation of the cylinder bar and the cam.

6. The lock as claimed in claim 1, with the outside handle being a lever.

7. The lock as claimed in claim 1, with the outside hub including an outside seat, the outside seat including an outer threading with two diametrically disposed flat surfaces, further including a reinforcing ring and an adjusting sleeve, the reinforcing ring including two positioning posts extending outward therefrom and two diametrically disposed flat sections in an inner periphery delimiting a hole thereof, the reinforcing ring being mounted around the outside seat, with the flat sections of the reinforcing ring being in contact with the flat sections of the outside seat, the adjusting sleeve including an inner threading threadedly engaged with the outer threading of the outside seat, an outside rose being mounted to the outside handle, the adjusting sleeve being securely engaged with the outside rose, wherein rotation of the outside rose causes longitudinal movement of the adjusting sleeve and the outside rose until the retractor is located in a center of a thickness of a door to which the lock is mounted.

8. The lock as claimed in claim 7, with each said positioning post of the reinforcing ring having a screw hole, further including an inside rose liner mounted around the inside hub, the inside rose liner including at least one pair of positioning holes, with two screws extending through one of said at least one pair of positioning holes of the inside rose liner into the screw holes of the positioning posts of the reinforcing ring.

9. The lock as claimed in claim 8, with the inside rose liner including a threaded inner periphery, with the inside hub including an outer threading threadedly engaged with the threaded inner periphery of the inside rose liner.

10. The lock as claimed in claim 7, with the outside rose including a central stepped portion having a central through-hole, with the adjusting sleeve having an end securely engaged with the central stepped portion of the outside rose.

* * * * *